US010922964B2

(12) United States Patent
Fowe

(10) Patent No.: US 10,922,964 B2
(45) Date of Patent: Feb. 16, 2021

(54) MULTI-MODAL TRAFFIC DETECTION

(71) Applicant: HERE Global B.V., Eindhoven (NL)

(72) Inventor: James Fowe, Chicago, IL (US)

(73) Assignee: HERE GLOBAL B.V., Eindhoven (NL)

( * ) Notice: Subject to any disclaimer, the term of this patent is extended or adjusted under 35 U.S.C. 154(b) by 340 days.

(21) Appl. No.: 15/863,183

(22) Filed: Jan. 5, 2018

(65) Prior Publication Data

US 2019/0213874 A1 Jul. 11, 2019

(51) Int. Cl.
*G08G 1/01* (2006.01)
*G08G 1/0967* (2006.01)

(52) U.S. Cl.
CPC ..... *G08G 1/0133* (2013.01); *G08G 1/0112* (2013.01); *G08G 1/0141* (2013.01); *G08G 1/0967* (2013.01)

(58) Field of Classification Search
CPC ..... G01C 21/00; G01C 21/005; G01C 21/10; G01C 21/12; G01C 21/16; G01C 21/20; G01C 21/26; G01C 21/34; G01C 21/36; B60W 2550/00; B60W 2550/20; B60W 2550/30; B60W 2550/40; B60W 2550/402; B60W 2550/406; H04W 4/00; H04W 4/02; H04W 4/024; H04W 4/025; H04W 4/027; H04W 4/029; G08G 1/00; G08G 1/01; G08G 1/0104; G08G 1/0133; G08G 1/0112; G08G 1/0141; G08G 1/0125; G08G 1/0137; G08G 1/048; G08G 1/0123; G08G 1/0967
USPC ..... 701/119
See application file for complete search history.

(56) References Cited

U.S. PATENT DOCUMENTS

| | | | | |
|---|---|---|---|---|
| 6,850,841 | B1 | 2/2005 | Casino | |
| 8,910,010 | B2 * | 12/2014 | Cooke | G01C 21/32 714/752 |
| 9,165,477 | B2 | 10/2015 | Wilson | |
| 9,208,682 | B2 | 12/2015 | Fowe et al. | |
| 9,424,745 | B1 | 8/2016 | Kagoshima et al. | |
| 9,558,660 | B1 | 1/2017 | Fowe et al. | |
| 9,709,406 | B2 * | 7/2017 | Bastiaensen | G01C 21/26 |
| 2007/0208501 | A1 | 9/2007 | Downs et al. | |
| 2017/0074663 | A1 | 3/2017 | Giurgiu et al. | |

OTHER PUBLICATIONS

Schikuta, E., *Grid-Clustering: A Fast Hierarchical Clustering Method for Very Large Data Sets*, Center for Research on Parallel Computation, Rice University, CRPC-TR93358(Nov. 1993) 16 pages.

* cited by examiner

*Primary Examiner* — Anthony R Jimenez
(74) *Attorney, Agent, or Firm* — Alston & Bird LLP

(57) ABSTRACT

A method is disclosed, performed by at least one apparatus, the method comprising: obtaining probe data comprising a plurality of probe samples of a multi-dimensional probe sample space, the probe data being representative of a potentially multi-modal traffic scenario; performing a cluster analysis for at least a part of the probe samples of the probe data, said cluster analysis comprising: associating at least a part of the probe samples with respective clusters, each cluster being representative of a mode of the potentially multi-modal traffic scenario.

25 Claims, 11 Drawing Sheets

MULTI-MODAL TRAFFIC DETECTION

FIELD

The invention relates to the field of processing data, such as positioning data (e.g. of a radio network), in particular for traffic analyzing and traffic reporting.

BACKGROUND

Nowadays different approaches exist to determine a route that shall be navigated by a device (e.g. a terminal), such as for instance a car-mounted navigation device or a hand-held navigation device. The route may for instance be determined locally at the terminal, based on a map (e.g. in the form of several map regions) that may be locally stored at the device. The route itself may for instance comprise a plurality of travel network segments or links (e.g. roads, intersections, etc.) contained in the device's map.

In order to further improve navigation, often additional information is utilized. Such additional information may be up-to-date traffic information (e.g. traffic jams in certain segments of the travel network). For this, a real-time or near real-time processing of positioning data (e.g. GPS data) and reporting of traffic is often needed.

However, there are segments of the travel network that need a special handling and special processing algorithms in order to capture accurate traffic information. This is particularly the case, when lane-level traffic information is desired. For instance, it has been realized that performing a simple speed averaging in order to derive the average speed of traffic participants in the respective segment could produce wrong traffic information. One approach to mitigate this problem is the use of analyzing divergent traffic speeds before splitting junctions. This can be realized with special algorithms rather than doing a naïve speed averaging producing wrong traffic information. However, these approaches are only designed to and are only able to solve bi-modal traffic distribution problems caused by a traffic condition upstream of a junction that splits into two directions downstream of the junction.

Considering for example a road that split into more than two, e.g. three roads downstream of a junction, there is the potential of having a tri-modal speed distribution. For instance, at an arterial intersection the speed of the traffic participants may be different for a right-turn lane and a left-turn lane. Theses speeds may again be different from going straight on the road, resulting in a tri-modal speed distribution. It is difficult to do a lane-level separation of these divergent traffic speeds, in particular in view of the generally noisy positioning data. The same problem may occur in case of a road segment with multiple exiting ramps or a road segment with a HOV lane and also an exit ramp. The same problem may arise for data collected from different means of transportation like bikes, cars and pedestrians using the same road at the same time. Data collected from such scenarios cannot be reliably handled by current algorithms. Thus, a detection of such tri-modal scenarios, e.g. a tri-modal speed distribution, and an accurate identification of the single modes is not reliable.

This is in particular the case, because obtaining lane-level information from a single satellite networks source or a lane direction is non-trivial due to many errors in the signal probes, which makes it nearly impossible to obtain accurate traffic on roads that have such tri-modal distributions.

Ideally, these probes can be reliably separated so as to obtain the average real-time speed or trip volume for each mode of transportation.

SUMMARY OF SOME EXAMPLE EMBODIMENTS

It is thus an object of the invention to reduce the above mentioned problems. It is in particular an object to provide a method that will allow for reliably identifying modes of multi-modal traffic distributions so as to be able to separate and process the respective probe data. It is another object to provide a method that is fast, scalable and that works well with noisy data.

According to a first exemplary aspect of the invention, a method is described, performed by at least one apparatus, the method comprising:

- obtaining probe data comprising a plurality of probe samples of a multi-dimensional probe sample space, the probe data being representative of a potentially multi-modal traffic scenario;
- performing a cluster analysis for at least a part of the probe samples of the probe data, said cluster analysis comprising:
- associating at least a part of the probe samples with respective clusters, each cluster being representative of a mode of the potentially multi-modal traffic scenario.

This method may for instance be performed and/or controlled by one or more apparatuses (e.g. an exemplary apparatus of a further aspect as described herein), in particular by a server or a server cloud, or by a part of a server or server cloud.

According to a further exemplary aspect of the invention, an apparatus is disclosed, which comprises means for performing the method according to the first aspect of the invention. The means of the apparatus can be implemented in hardware and/or software. They may comprise for instance at least one processor for executing computer program code for performing the required functions, at least one memory storing the computer program code, or both. Alternatively, they could comprise for instance circuitry that is designed to implement the required functions, for instance implemented in a chipset or a chip, like an integrated circuit. In general, the means may comprise for instance one or more processing means.

According to a further exemplary aspect of the invention, an apparatus is disclosed, which comprises at least one processor and at least one memory including computer program code, the at least one memory and the computer program code configured to, with the at least one processor, cause an apparatus at least to perform the method and/or the steps of the method according to the first aspect of the invention.

The disclosed apparatuses according to any aspect of the invention may be modules or components for a device, for example chips. Alternatively, the disclosed apparatuses according to any aspect of the invention may be devices, for instance servers or server clouds (e.g. a plurality of servers that jointly provide a service). The disclosed apparatuses according to any aspect of the invention may comprise only the disclosed components (e.g. means) or may further comprise one or more additional components.

According to a further exemplary aspect of the invention, a computer program code is disclosed, the computer program code when executed by a processor causing an apparatus to perform the actions of the method of the first aspect of the invention.

The computer program code may be stored on computer-readable storage medium. The computer readable storage medium could for example be a disk or a memory or the like. The computer program code could be stored in the computer readable storage medium in the form of instructions encoding the computer-readable storage medium. The computer readable storage medium may be intended for taking part in the operation of a device, like an internal or external memory (e.g. a Read-Only Memory (ROM)) or hard disk of a computer, or be intended for distribution of the program, like an optical disc.

According to a further exemplary aspect of the invention, a system is disclosed, comprising a first apparatus according to any previously described aspect of the invention and a navigation device configured to receive traffic information provided or held available by the first apparatus. The navigation device may for instance be a device, which may be embodied as an electronic device. The navigation device may for instance be a portable device or a device that is installed in a vehicle.

The navigation device may use the received traffic information for a route calculation of a route comprising the respective traffic scenario (e.g. a travel network segment).

In the following, further exemplary features and embodiments of these aspects of the invention will be described.

The probe samples lie in a multi-dimensional sample space. Thus, each probe sample may for instance comprise an entry for each dimension of the multidimensional probe sample space. For instance, in case of a two-dimensional probe sample space each probe sample may for instance comprise at least two entries, e.g. a first and a second entry. The first entry may describe a value of the probe sample with respect to the first dimension of the probe sample space; the second entry may describe a value of the probe sample with respect to the second dimension of the probe sample space. The plurality of probe samples may be seen as a subset of the probe sample space. Accordingly, the probe data may be seen as a subset of the multi-dimensional probe sample space.

Thus, the term multi-dimensional is understood to mean at least two dimensions. While the probe sample space may have more than two dimensions, in a preferred embodiment the probe sample space has precisely two dimensions. At least one dimension may be a spatial dimension. At least one dimension may be a dimension other than a spatial dimension. For instance, one dimension may be a velocity dimension. Each probe sample may in particular be understood to describe a point in multi-dimensional probe sample space. The data structure describing the probe samples may take any suitable form. In one example, a probe sample may be described by a matrix or a vector, e.g. a two-dimensional vector.

The probe data may thus comprise information on a distribution of probe samples in the multi-dimensional probe sample space.

The probe data may also comprise additional data, such as a time stamp indicating the time at which the measurement for obtaining the probe sample was taken.

The probe data may be collected by traffic participants, e.g. of the traffic scenario. The probe data may be obtained from the traffic participants. A traffic participant may provide one or more of the probe samples.

In one example, a probe sample comprises or is based on positioning information of a positioning network, e.g. a satellite navigation network, such as NAVSTAR GPS, or a communication network, such as a cellular or a wire local area network.

A traffic scenario may be understood to be a traffic situation in a certain geographical region or with respect to one or more parts or one or more elements of a map (representing a certain geographical region) at a certain time. Traffic participants of a traffic scenario may comprise vehicles (e.g. motor vehicles, such as motorcycles, cars, trucks, buses), bicycles and/or pedestrians.

A multi-modal traffic scenario may in particular be understood to be a traffic scenario, wherein one or more variables of the scenario can be described by a (multi-dimensional, e.g. two dimensional) probability distribution which has two or more modes, i.e. two or more local maxima or distinct peaks. A multi-modal traffic scenario may in particular be an at least bi-modal traffic scenario. In an example the probe data is representative of a (potentially) tri-modal traffic scenario.

That the probe data is representative of a potentially multi-modal traffic scenario is in particular understood to mean, that it might not be known at the time of performing the method and in particular the cluster analysis, whether the traffic scenario the probe data is representative of is in fact multi-modal (or only unimodal).

The probe data is used as an input for the cluster analysis, so that a cluster analysis can be performed for at least a part of the probe samples of the probe data. A cluster analysis (which may also be termed cluster search or clustering) is in particular understood to be grouping a set of objects (e.g. the probe samples of the probe data) in such a way that objects in the same group (i.e. cluster) are more similar (e.g. with respect to one or more properties) to each other than to those in other groups (i.e. clusters). As a result at least a part of the probe samples is associated with a respective cluster. Therein, a cluster is representative of a mode of the potentially multi-modal traffic scenario.

As explained, the probe data is used as an input for the cluster analysis. Additional information, such as a gap value, may also be input into the cluster analysis, as will be described in more detail below. However, the number of clusters (also kwon as the k-value), is in a preferred embodiment not an input parameter for the cluster analysis. Rather, the number of cluster is an output value of the cluster analysis, as will also be explained in more detail below.

The described method and in particular the cluster analysis may in particular be performed in real time. Real time is understood to mean that the method is able to provide results of the cluster analysis, in particular traffic information based thereon, such that the results describe the present or current traffic situation. Alternatively, the method may also be performed in batch processing and the probe data may data stored for a longer time.

The cluster analysis may in particular be a grid-based approach.

According to an exemplary embodiment of the different aspects of the invention one dimension of the multi-dimensional probe sample space indicates velocities of respective traffic participants and/or one dimension of the multi-dimensional probe sample space indicates geographical positions of respective traffic participants.

The velocity may be a momentary or an averaged velocity of a traffic participant in the traffic scenario to be assessed, e.g. in a specific segment of a travel network. The position may be a relative geographic position of a traffic participant (e.g. relative to a reference, e.g. a certain feature of the respective segment of the travel network) in the traffic scenario to be assessed. In one example, the geographical position of a respective traffic participant may be the distance (also called d-value) of the traffic participant from the center line of a road segment of a travel network of the traffic scenario. The position may also be an absolute geographic position of a traffic participant (e.g. a geographic position on the surface of the earth) in the traffic scenario to be assessed. Preferably, one dimension of the multi-dimensional probe sample space indicates velocities of respective traffic participants and one dimension of the multi-dimensional probe sample space indicates geographical positions of respective traffic participants.

It may also be possible to use probe sample spaces with additional and/or other dimensions. For instance, the multi-dimensional probe sample space may have dimension for more than one dimension indicating a geographical position of respective traffic participants, for instance the multi-dimensional probe sample space may have two or three dimensions indicating a two-dimension or three-dimensional geographical positions of respective traffic participants. As another example the multi-dimensional probe sample space may also have a dimension indicating (travel) directions of respective traffic participants, e.g. instead of a dimension indicating geographical positions of respective traffic participants.

A probe sample of the multi-dimensional probe sample space may thus be understood to represent a state (e.g. position, direction, and/or velocity) of a respective traffic participant.

According to an exemplary embodiment of the different aspects of the invention, each of at least a part of the probe samples may thus comprise information representative of a respective velocity of a traffic participant and/or information representative of a geographical position of a respective traffic participant.

Preferably, each of at least a part of the probe samples comprises at least both, information representative of a respective velocity of a traffic participant and information representative of a geographical position (e.g. a one-dimensional, two-dimensional or three-dimensional position) of a respective traffic participant. Since the probe samples lie within the multi-dimensional probe sample space, the probe samples preferably comprise information about each of the dimensions of the multi-dimensional probe sample space, as described above. Thus, each of at least a part of the probe samples may also comprise additional or other information, e.g. information representative of a respective direction of a traffic participant.

According to an exemplary embodiment of the different aspects of the invention, the traffic scenario relates to the traffic at a travel network segment. A travel network may be a road network, for instance. A segment of a travel network may for instance be a link of the travel network, for example a section between two junctions of the travel network. Such a segment may be a directional segment (i.e. only relating to one travel direction on the segment) or a non-directional segment (relating to more than one travel direction on the segment). Each segment may be associated with a segment identifier (e.g. a unique link identifier). Preferably, the travel network segment comprises multiple (e.g. at least two or at least three) lanes. A lane may be understood to be part of the segment (e.g. link) of the travel network that is designated for use by a single line of traffic participants (e.g. vehicles) travelling in the same direction.

According to an exemplary embodiment of the different aspects of the invention, the travel network segment comprises or is adjacent to a travel network segment that comprises multiple, in particular at least three different lanes and/or splits into multiple, in particular at least two, preferably at least three different directions. A travel network segment that comprises multiple lanes and/or splits into multiple different directions (or the travel network segment upstream thereof) is likely to produce a multi-modal in particular a tri-modal traffic scenario.

In one example, only probe data collected at such travel network segments is used for the cluster analysis. Probe data collected at other network segments which typically do not produce multi-modal traffic scenarios may be processed differently.

According to an exemplary embodiment of the different aspects of the invention, the travel network segment comprises at least one restricted traffic lane, in particular a high-occupancy vehicle lane.

A restricted traffic lane is understood as a lane with restricted access. A restricted traffic lane may be understood to be a lane, which only certain traffic participants or a certain group of traffic participants are allowed and/or are able to use. A high-occupancy vehicle lane (also known as an HOV lane, carpool lane, diamond lane, 2+ lane, and transit lane or T2 or T3 lane) is a restricted traffic lane reserved (e.g. generally or only at peak travel times) for the exclusive use of vehicles with a certain amount of occupants (e.g. a driver and one or more passengers, including carpools, vanpools, and transit buses). A typical minimum occupancy level is 2 or 3 occupants. Many jurisdictions exempt other vehicles, including motorcycles, charter buses, emergency and law enforcement vehicles, low-emission and other green vehicles, and/or single-occupancy vehicles paying a toll.

HOV lanes may be either a single traffic lane within the main roadway with distinctive markings or a separate roadway with one or more traffic lanes either parallel to the general lanes or grade-separated, above or below the general lanes. HOV bypass lanes allow carpool traffic to bypass areas of regular congestion in many places. A HOV lane may operate as a reversible lane, e.g. working in the direction of the dominant traffic flow in both the morning and the afternoon.

According to an exemplary embodiment of the different aspects of the invention, a mode of the potentially multi-modal traffic scenario represents a group of traffic participants using the same lane (e.g. the right lane, the left lane, the middle lane), using the same means of transportation (e.g. a participant traveling by car, by bicycle, by foot), moving in a certain direction, and/or having a certain velocity.

That the traffic participants are moving at a certain direction or velocity, is understood that the traffic participants may individually move into different directions or at different velocities, but that a certain (e.g. mean) direction or velocity can be associated to the group.

In a preferred example, each mode of the potentially multi-modal traffic scenario represents a group of traffic participants using the same lane and having a certain velocity.

According to an exemplary embodiment of the different aspects of the invention, said method further comprises:

obtaining a gap value indicative of a threshold gap distance between a potential cluster element and a cluster for deciding whether the potential cluster element is to be added to said cluster and preferably using said gap value as an input for said cluster analysis.

A cluster element is understood to be a probe sample, for instance, which may not yet have been associated or added to a certain cluster. Since it has to be decided whether the cluster element is actually added to the cluster, the cluster element is termed a potential cluster element. It may also be possible that the cluster element comprises multiple probe samples. The cluster element under consideration may for instance be a bucket comprising one or more probe samples, as described in more detail further below.

The gap value can for instance be a value between a maximum and a minimum border. In one example, the gap value can have a value from 0 to 1. The gap value may indicate a fraction of the total size of the probe sample space cover by the probe data. The gap value may be used for determining a threshold gap distance as explained further below. The gap value may be predetermined. The gap value may serve as an input for the cluster analysis.

In the following actions which may in particular be part of the cluster analysis are described:

According to an exemplary embodiment of the different aspects of the invention, said cluster analysis further comprises:

determining a threshold gap distance, wherein said threshold gap distance is preferably based on said obtained gap value.

As explained above, the threshold gap distance between a potential cluster element and a cluster can be used for deciding whether the potential cluster element is to be added to said cluster. For instance, if the distance between a potential cluster element and a cluster is larger or not smaller than the threshold gap distance, the potential cluster element is not to be added to said cluster. For instance, if distance between a potential cluster element and a cluster is smaller or not larger than the threshold gap distance, the potential cluster element is to be added to said cluster.

As one example, the threshold gap distance may be determined based on the obtained gap value. For instance, the threshold gap distance may be determined by multiplying the gap value with a value representing the size probe sample space covered by the probe data, such as a distance (e.g. the Euclidian distance) through the probe sample space, e.g. "Euclidean distance(max(probe data), 0)".

According to an exemplary embodiment of the different aspects of the invention, said cluster analysis further comprises;

detecting whether one or more probe samples of probe data are outliers; and disregarding a probe sample if it is determined that the respective probe sample is an outlier.

An outlier may be understood as a probe sample that does not fit into the probe data or which does not fulfill expectations, e.g. which is (too) distant from the other probe samples. Whether a probe sample is to be considered as an outlier may in particular be detected before the respective probe sample is associated with or added to a cluster. As an example, a probe sample may be considered an outlier if the probe sample is too distant (e.g. further away than a certain number of standard deviations (e.g. two standard deviations) from the sample mean.

According to an exemplary embodiment of the different aspects of the invention, said cluster analysis further comprises:

defining a plurality of buckets, each bucket being associated with a section of the multi-dimensional probe sample space; and for each of said buckets filling the respective bucket with probe samples lying within a respective section of the multi-dimensional probe sample space, with which the respective bucket is associated.

A bucket is in particular understood to be a type of data structure or buffer in which data is divided into regions. If a bucket is filled with a probe sample, the probe sample may be understood to be contained in the bucket. The contents of a bucket may in particular be unsorted. A bucket may have a fixed size, which may be determined when it is created. A bucket may have different states: a bucket may be empty, or (partially) filled. As an example, buckets may be realized by a matrix, wherein each matrix element may be a bucket. The size of the matrix determines the number of buckets. The dimension of the matrix preferably corresponds to the dimensions of the multi-dimensional probe sample space. For instance, if the multi-dimensional probe sample space has two dimensions, the matrix may be a two dimensional matrix with e.g. 20×20 elements (i.e. buckets). The matrix may in particular be a square matrix. The cluster analysis may in particular be a grid-based bucket approach.

The number of buckets in one dimension may be predetermined. The number of buckets may depend on the size of the probe sample space covered by the prove data and/or the number of probe samples. The number of buckets in one dimension may be at least 5, at least 10 or at least 15. The number of buckets in one dimension may be at most 100, at most 50 or at most 25. The number of buckets may be 20 in each dimension.

According to an exemplary embodiment of the different aspects of the invention, said cluster analysis further comprises:

creating a priority order, said priority order indicating a processing order of the buckets during the cluster analysis, wherein said priority order is in particular based on a distance, preferably a Chebyshev distance of a respective bucket to a reference point.

The distance of a bucket to a reference point may be understood to be the distance between a mean value of the bucket (e.g. a mean value of the probe samples in a bucket) to the reference point. The reference point may be a reference point in the bucket structure (e.g. an origin of the bucket structure). Preferably, the distance is determined with the Chebyshev distance. However, other metrics may also be used. The priority order may also indicate that certain buckets have the same priority order (i.e. that there is (in part) no specific processing order, e.g. because they have the same distance to the reference point). Such buckets with the same priority may be processed in any order (e.g. random).

According to an exemplary embodiment of the different aspects of the invention, said cluster analysis further comprises:

checking whether a distance between a respective bucket and a cluster is less or not greater than a threshold gap distance; and associating the probe samples, which are contained in the respective bucket, with the cluster, if it is determined by the checking that the distance between the respective bucket and the cluster is less or not greater than a threshold gap distance.

The threshold gap distance may be a threshold gap distance as already described and may be determined as described (e.g. based on a gap value). By repetition of this action, clusters can be populated step by step by associating the respective probe samples with respective clusters. For instance, this action may be repeated for each created (non-empty) bucket. Therein, the buckets are assessed in the order of a priority order, e.g. a priority order as described and/or determined above.

In case no cluster has yet been created, a cluster may be created and the probe samples, which are associated with the respective bucket, may be associated with this (first) cluster.

In case it is determined by the checking that the distance between the respective bucket and the cluster is not less or greater than a threshold gap distance, it may be checked whether a distance between a respective bucket and any further already existing cluster is less or not greater than a threshold gap distance.

As already described with respect to the threshold gap distance, the distance between a bucket and a cluster may be a Euclidian distance for example.

According to an exemplary embodiment of the different aspects of the invention, said cluster analysis further comprises:

creating a new cluster and associating the probe samples, which are contained in the respective bucket, with the new cluster, if it is determined by the checking that the distance between the respective bucket and all clusters is greater or not less than a threshold gap distance.

Thus, if the bucket is too distant from all clusters created so far, a new cluster is created associated with the probe samples, which are contained in the respective bucket.

The above described steps may be repeated for every (non-empty) bucket.

As a result, the cluster analysis may return an output comprising the cluster created by the cluster analysis, e.g. a list of cluster and/or information about the clusters, e.g. the probe samples associated with a cluster.

It may be the case, that certain probe samples may have not been detected as outliers, or that no outlier detection has been performed before associating probe samples with respective clusters. Thus, a cluster may also be an outlier. Thus, according to an exemplary embodiment of the different aspects of the invention, said method further comprises:

detecting whether one or more clusters determined by said cluster analysis are outliers; and disregarding a cluster if it is determined that the respective cluster is an outlier.

The detection, whether a cluster can be considered an outlier, may in particular be based on the probe count (i.e. the number of probe samples associated with the cluster). For instance, a cluster may be considered as an outlier, if the number of probe samples in the cluster is smaller (or not greater) than a predefined threshold. For instance, a cluster may be considered as an outlier, if the number of probe samples in the cluster is not greater than "1" (i.e. only a single probe sample was associated with the cluster). However, the threshold may also depend on the overall probe count (i.e. the number of probe samples comprised by the probe data or associated with all clusters). In another example, the threshold may be a certain fraction of the average (total or cluster) probe count.

According to an exemplary embodiment of the different aspects of the invention, said method further comprises:

determining a mean of each determined cluster (except any cluster to be disregarded) for obtaining traffic information from said determined clusters.

The mean of a cluster may be understood to be the mean of the probe samples associated with the respective cluster. The mean may be understood to be the center or a central value of the respective cluster. The mean may be calculated by averaging the probe samples associated with the respective cluster, for example. The mean may be an arithmetic mean, a geometric mean or a median, for example.

For instance, if the probe samples each comprise information representative of a respective velocity of a traffic participant and information representative of a geographical position (e.g. d-value) of a respective traffic participant, the mean of a determined cluster comprises a mean geographical position (e.g. a mean d-value) and a mean velocity. Accordingly, the traffic information comprises for each cluster a mean geographical position (e.g. a mean d-value) and a mean velocity. In this way, traffic information for each mode of the multi-modal traffic scenario is obtained.

According to an exemplary embodiment of the different aspects of the invention, said method further comprises:

providing or holding available traffic information comprising information representative of or derived from said determined clusters.

The providing or holding available of traffic information may be understood as publishing the traffic information, e.g. to traffic participants. The traffic information may in particular comprise the determined mean of a cluster, as described above. For instance, if one dimension of the multi-dimensional probe sample space indicates velocities of respective traffic participants and one dimension of the multi-dimensional probe sample space indicates geographical positions of respective traffic participants (such as d-values), the traffic information may comprise information representative of a mean velocity and a mean geographical position (e.g. mean value) for each cluster. Preferably, the traffic information may comprise information representative of a lane-level mean velocity (that is a velocity for one or more lanes).

According to an exemplary embodiment of the different aspects of the invention, said traffic information is provided or held available, if it is determined that a multi-modal traffic scenario is given. Thus, it may first be checked, if a multi-modal traffic scenario is given and only if that is the case, the traffic information may be provided or held available (i.e. published). However, it may also be the case that further conditions need to be fulfilled in order to provide or hold available the traffic information. In other words, the existence of a multi-modal traffic condition may be necessary but not sufficient for publishing the traffic information. For instance, in order to provide or hold available the traffic information it may also be necessary that the degree of separation of the different modes of the multi-modal traffic scenario is large enough (e.g. above a threshold). For instance, the determined mean velocity for a determined cluster (i.e. mode) may need to be sufficiently different from another determined mean velocity of a determined cluster (i.e. mode). For instance, in order to provide or hold available the traffic information it may be necessary that the impact (e.g. in terms of a travel time) of the detected multi-modal traffic scenario on a route through the respective travel network segment is large enough (e.g. above a threshold), e.g. compared to when not considering the multimodal traffic scenario (e.g. only considering a unimodal traffic scenario). For instance, in order to provide or hold available the traffic information it may also be necessary that the confidence of determined multi-modal traffic scenario is large enough (e.g. a confidence value is large enough or a confidence interval is small enough).

According to an exemplary embodiment of the different aspects of the invention, said traffic information is provided to or held available for a navigation device. A navigation device may for instance be a portable device of a traffic participant or a device that is installed in a vehicle of a traffic participant. The traffic information may be used in a route calculation by the navigation device. The navigation device may determine a route comprising the travel network segment to which the multi-modal traffic scenario relates.

According to an exemplary embodiment of the different aspects of the invention, said method further comprises:

checking whether a number of clusters determined by said cluster analysis is not less or above a predefined threshold in order to determine whether a multi-modal traffic scenario is given.

For instance, a multi-modal traffic scenario may be determined if the number of clusters determined by said cluster analysis is not less than 3 (or above 2). In that case, a tri-modal traffic scenario can be assumed. However, other threshold values may be possible as well, depending on the situation.

According to an exemplary embodiment of the different aspects of the invention, said method further comprises:

determining confidence information for the result of the cluster analysis based on a cluster distance and/or a number of probe samples associated with the smallest cluster.

The confidence may indicate how reliable obtained information is. In one example, the confidence information may comprise a confidence value or a confidence interval for the means of the determined clusters. For instance, a confidence value may be based on a calibration constant, on an (average) cluster distance between the determined clusters, on a size (e.g. diagonal length) of the probe sample space (e.g. the bucket structure, e.g. a matrix) and/or on a number of probe samples associated with the smallest determined cluster. For instance, the confidence may be calculated by "Confidence=calibration constant*(average cluster distance/matrix diagonal length)*(minimum cluster count/all clusters count)".

According to an exemplary embodiment of the different aspects of the invention, said method further comprises:

providing or holding available the confidence information together with the traffic information.

The providing or holding available of the confidence information may be understood as publishing the traffic information, e.g. to traffic participants. For instance, the navigation device may use the confidence information for deciding whether to use the traffic information in a rout calculation performed e.g. by the navigation device

DETAILED DESCRIPTION OF EXAMPLE EMBODIMENTS

The following description serves to deepen the understanding of the present invention and shall be understood to complement and be read together with the description of example embodiments of the invention as provided in the above SUMMARY section of this specification.

Figure 1:
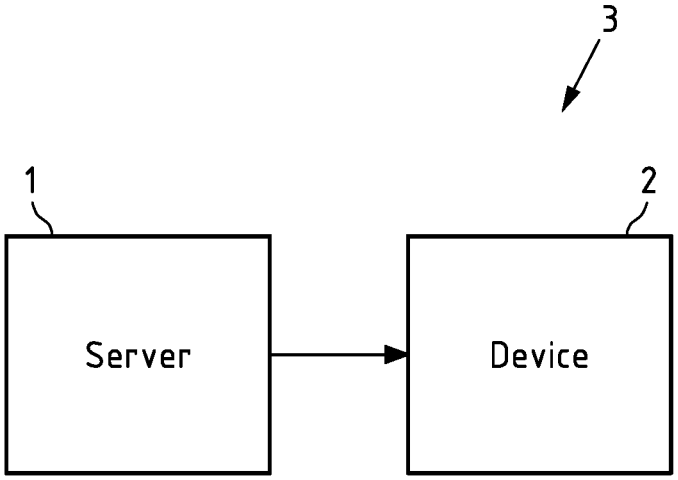
FIG. 1 shows a schematic block diagram of a system according to an example embodiment of the present invention.

FIG. 1 is a schematic block diagram of a system 3 according to an example embodiment of the present invention. System 3 exemplarily comprises a server 1 and a device 2.

For instance, device 2 is or forms a part (e.g. as a module) of a navigation device, in particular a Portable Navigation Device (PND), a smartphone, a tablet computer, a notebook computer, a navigation watch, or a navigation device that is fixedly installed in a vehicle, e.g. in the form of an in-dash device.

Server 1 is exemplarily configured to perform the method according to the first aspect of the invention.

Figure 2:
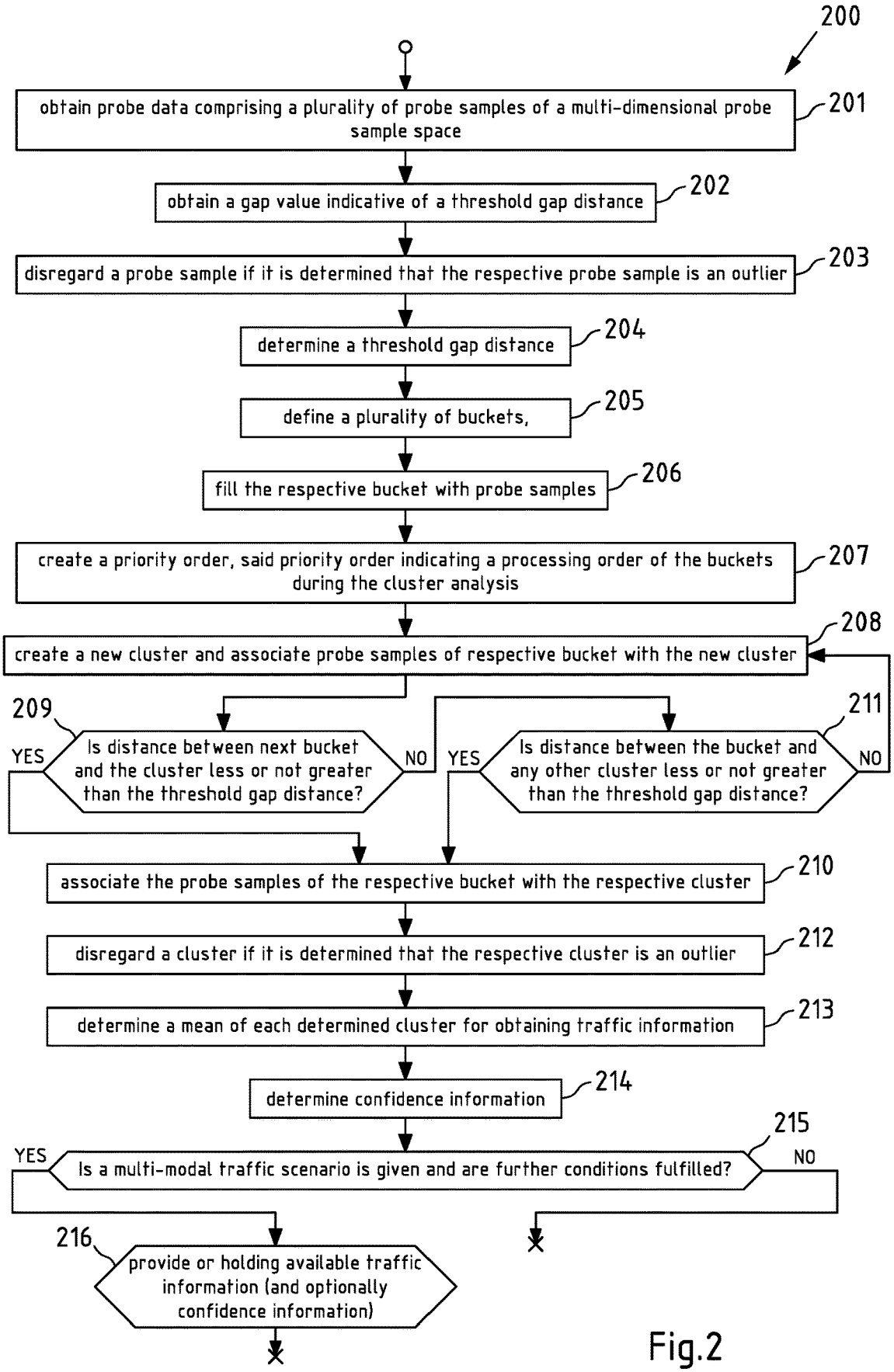
FIG. 2 shows a flowchart of an example embodiment of a method according to the present invention.

A flowchart 200 of an example embodiment of a method according to the present invention is shown in FIG. 2, which will be explained in the following also with reference to the further figures.

According to action 201, probe data is obtained. The probe data comprises a plurality of probe samples of a multi-dimensional probe sample space and is representative of a potentially multi-modal traffic scenario.

Figure 3:
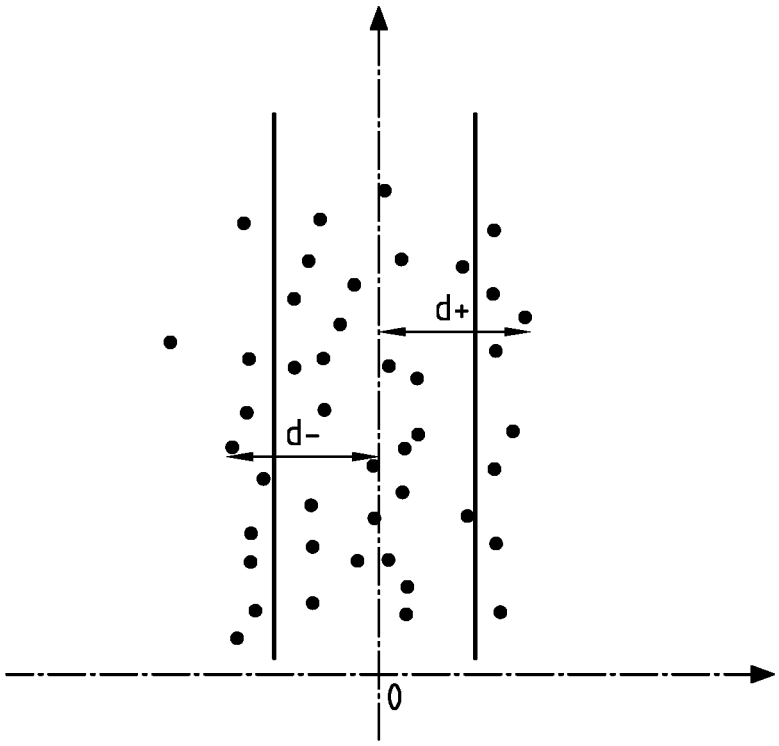
FIG. 3 shows a diagram with collected two-dimensional geographical positions (in x and y direction) of traffic participants.
Figure 4:
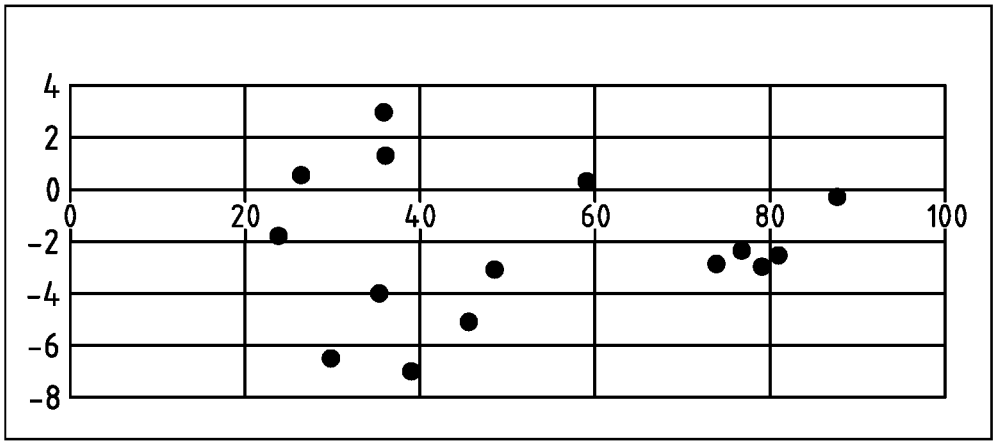
FIG. 4 shows a diagram with the velocity (y-axis) over the d-value (x-axis) for collected probe samples.

An example of probe data is exemplarily illustrated in FIGS. 3 and 4. FIG. 3 illustrates information representative of a geographical position of a respective traffic participant which may be comprised by probe data. Specifically, FIG. 3 illustrates in a diagram 300 the collected two-dimensional geographical positions (in x and y direction) of traffic participants. Also illustrated is a center line D of a road, the traffic participants are traveling along. The distance from the center line is called d-value. In the following, only one spatial dimension (here the distance of a respective traffic participant from the centerline (d-value)) is used for the further calculations.

Apart from the d-value, each probe sample of the probe data also comprises a velocity of the respective traffic participant. Thus, one dimension of the multi-dimensional probe sample space indicates a geographical position (the d-value). The other dimension of the multi-dimensional probe sample space indicates the velocity of the respective traffic participant. The probe data comprising the probe samples is illustrated in FIG. 4, showing a diagram 400 with the velocity (y-axis) over the d-value (x-axis) for collected probe samples. The probe sample space is two dimensional in this case. However, it may also be possible to use further dimensions (e.g. further spatial dimensions) in the probe sample space.

Figure 5:
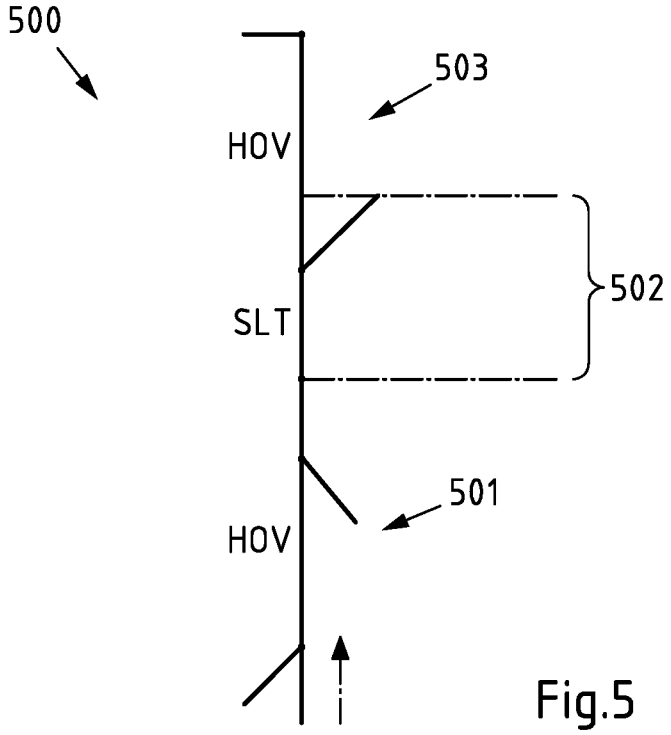
FIG. 5 shows a diagram illustrating travel network segments.

The traffic scenario, which is potentially multi-modal may in particular related to traffic at a travel network segment, which is exemplarily illustrated in the diagram 500 of FIG. 5. The travel network comprises two travel network segments 501, 503 (also called links) labeled "HOV", each of which comprise a regular lane and additionally a HOV (high-occupancy vehicle) lane. The segment or link 502 in between labeled "SLT" (split lane traffic) represents a road comprising a regular lane (going straight), a HOV lane and also an exit lane branching off. Due to the three different lanes with different characteristics, the traffic at the segment 502 is a candidate for producing a potentially multi-modal (in particular a tri-modal) traffic scenario, in particular with different velocities of the traffic participants on the respective lane.

Figure 6:
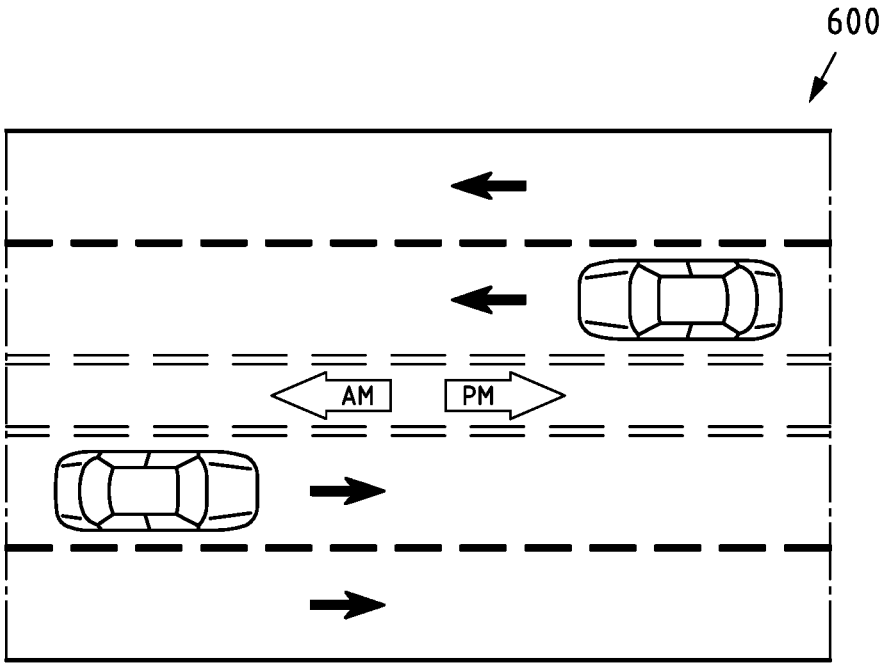
FIG. 6 shows a travel network segment with a HOV lane in top view.

FIG. 6 illustrates a schematic example of a travel network segment 600 with a HOV lane in top view. In this case there are two regular lanes in each direction and a central shared HOV lane, which can alternately be used in both driving directions. For instance, in the morning hours the HOV lane can be used for inbound traffic, while in the afternoon hours the HOV lane is used for outbound traffic. The presented approach is also able to deal with such scenarios.

Returning to FIG. 2, according to actions 202 a gap value is obtained. The gap value is an input to cluster analysis. The gap value is indicative of a threshold gap distance between a potential cluster element and a cluster for deciding whether the potential cluster element is to be added to said cluster and preferably using said gap value as an input for said cluster analysis (see actions 204, 209 below).

With the probe data and the gap value a cluster analysis for at least a part of the probe samples of the probe data may be performed. Actions 203 to 211, described in the following, may be regarded as the cluster analysis.

According to action 203, it is detected whether one or more probe samples of probe data are outliers. A probe samples is disregarded in the further cluster analysis, if it is determined that the respective probe sample is an outlier.

According to action 204, a threshold gap distance is determined. For determining the threshold gap distance, the obtained gap value is used.

According to action 205 a plurality of buckets is defined, wherein each bucket is associated with a section of the multi-dimensional probe sample space.

According to action 206, for each of said buckets, the respective bucket is filled with probe samples lying within a respective section of the multi-dimensional probe sample space, with which the respective bucket is associated.

According to action 207, a priority order is created. The priority order indicates a processing order of the buckets during the cluster analysis. The priority order is based on a Chebyshev distance of a respective bucket to a reference point (e.g. an origin of the probe sample space).

Figure 7:
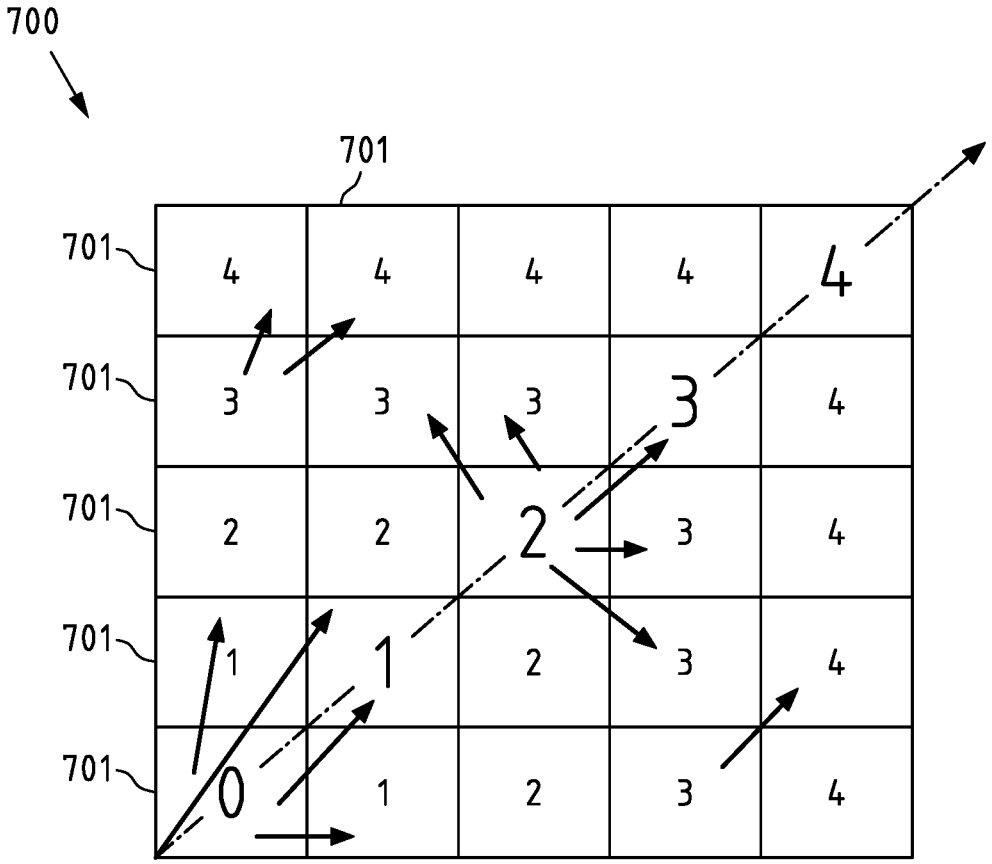
FIG. 7 shows a matrix defining a plurality of buckets.

A matrix 700 defining the plurality of buckets 701 is schematically illustrated in FIG. 7. The Chebyshev distance of a respective bucket to the origin (and thus the priority order of the respective bucket) is indicated with a number in each of the buckets. The distances between buckets are schematically illustrated by arrows. As can be seen, the distance increases along the diagonal of the matrix.

Returning to FIG. 2, according to action 208, the first non-empty bucket (according to the priority order) is considered and a new cluster is created. The probe samples contained in the respective bucket are associated with the cluster.

According to action 209, it is checked whether the distance between the next bucket in the priority order and the cluster is less or not greater than the threshold gap distance.

If the distance between the respective bucket and the cluster is less or not greater than the threshold gap distance, the probe samples, which are contained in the respective bucket, are associated with the cluster, action 210.

Otherwise, it is checked whether the distance between the bucket and any other cluster (if there are any further clusters) is less or not greater than the threshold gap distance, action 211. If that is the case, the probe samples, which are contained in the respective bucket, are associated with the cluster, action 210.

Otherwise, a new cluster is created and the probe samples, which are contained in the respective bucket, are associated with the new cluster, action 208.

These steps are repeated for all (non-empty) buckets.

In this way at least a part of the probe samples are associated with respective clusters. Each of the clusters may be considered as being representative of a mode of the potentially multi-modal traffic scenario.

According to action 212, it is detected whether one or more clusters determined by said cluster analysis are outliers and in that case the respective cluster is disregarded.

According to action 213 a mean of each determined cluster is determined for obtaining traffic information from said determined clusters.

The results of exemplary cluster analyses are illustrated in FIGS. 8 to 11.

Figure 8A:
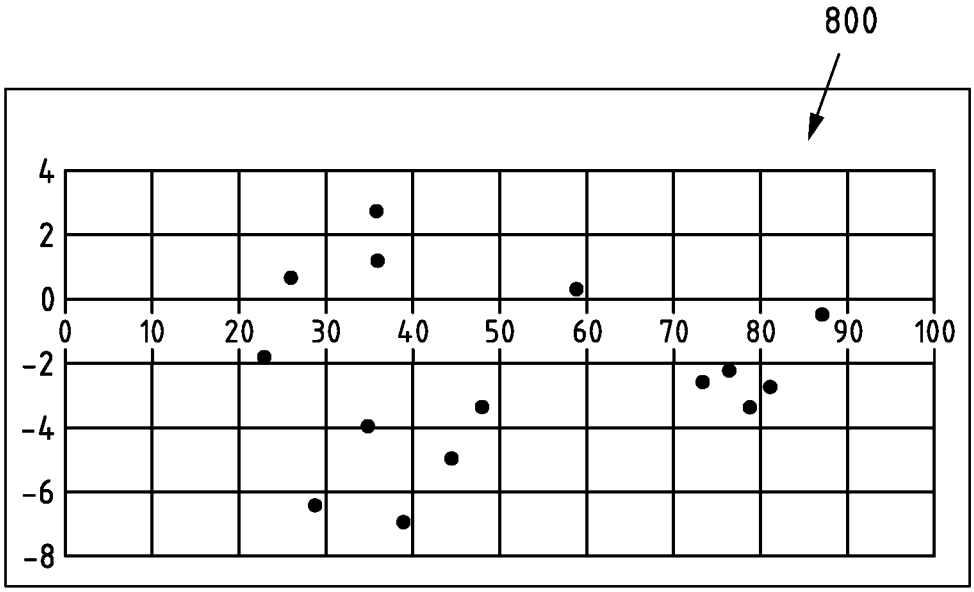
FIG. 8*a,b* illustrates probe data and clusters resulting from a cluster analysis.

FIG. 8*a* illustrates probe data 800 comprising probe samples in the probe sample space (each probe sample comprising a d-value and a velocity value), which were collected in a travel network segment with three different types of lanes (HOV lane, regular lane, exit lane), such as travel network segment 502 of FIG. 5.

Figure 8B:
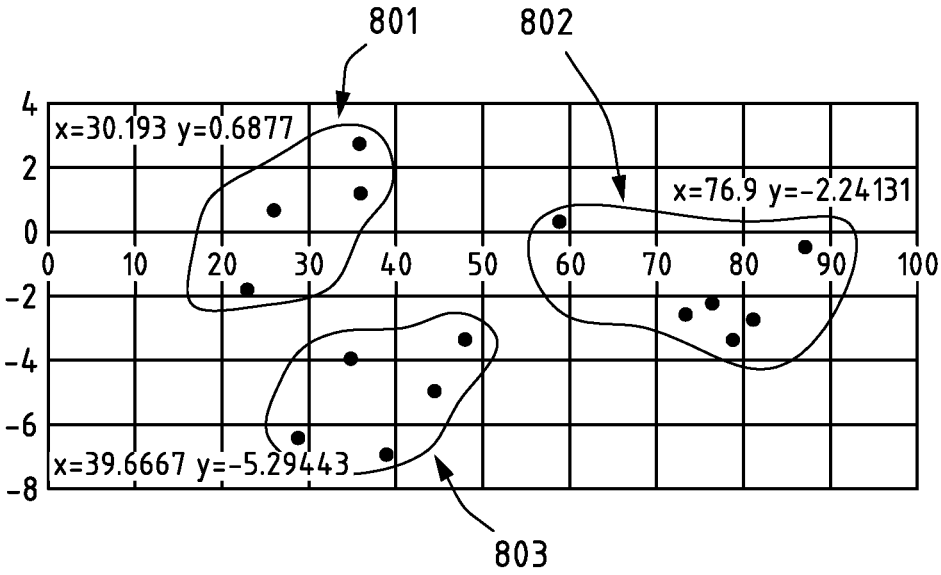

The cluster analysis returns three clusters 801, 802, 803 illustrated in FIG. 8*b*. The mean values of the clusters are given in the Figure. The clusters can be interpreted as a mode each, i.e. as traffic participants having an average velocity on the regular lane(s) of approximately, 30 km/h (cluster 801), as traffic participants having an average velocity on the HOV lane(s) of approximately 77 km/h (cluster 802), and as traffic participants having an average velocity on the lane(s) towards the exit ramp of approximately 40 km/h.

Figure 9A:
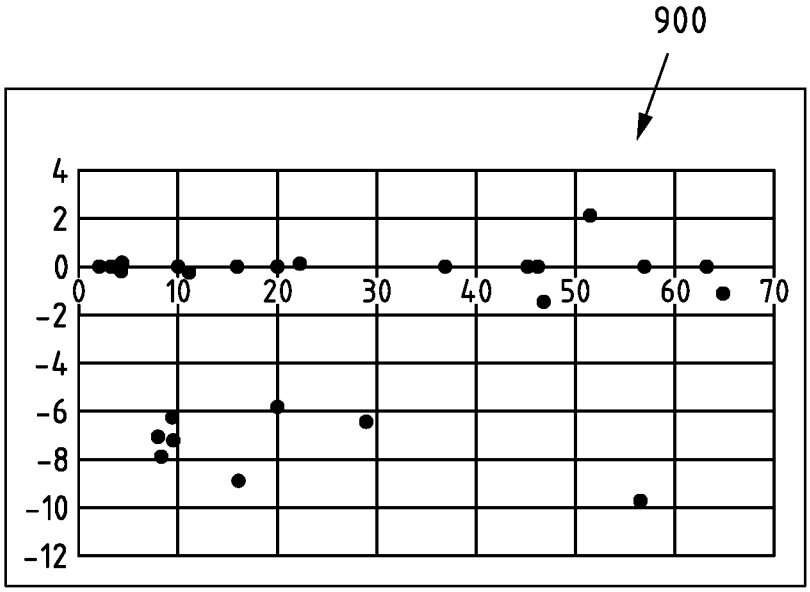
FIG. 9*a,b* illustrates probe data and clusters resulting from a cluster analysis.

Similarly, FIG. 9*a* illustrates probe data 900 comprising probe samples in the probe sample space (each probe sample comprising a d-value and a velocity value), which were collected in a travel network segment with three different types of lanes (HOV lane, regular lane, exit lane), such as travel network segment 502 of FIG. 5.

Figure 9B:
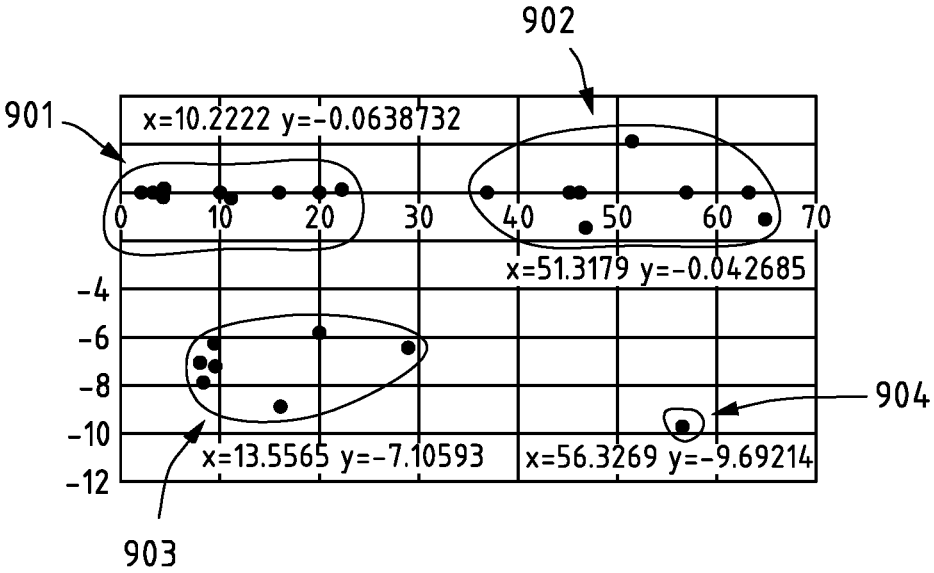

The cluster analysis returns four clusters 901, 902, 903, 904 illustrated in FIG. 9*b*. The mean values of the clusters are given in the Figure. Because the cluster 904 containing only a single probe sample compared to the large probe-count in the other clusters 901, 902, 903, this cluster 904 is considered as an outlier and disregarded (e.g. deleted). The remaining clusters 901, 902, 903 can be interpreted as a mode each. FIG. 9*b* shows why an algorithm not taking account of the d-value would not provide reliably results. If one only looks at the velocities, the two congested clusters 901, 903 would be merged into one assuming that all the traffic participants with velocities <30 km/h are going in the same direction. But the d-value displacement shows clearly that there is a subset of the congested cluster that is closer to the center-lane of the road (y=0) while the other subset is farther away, which is an indication of representing traffic participants on another lane going towards for example a congested exit ramp. However the HOV lane(s) remain fairly fast with an average speed of approximately 51 km/h.

Figure 10A:
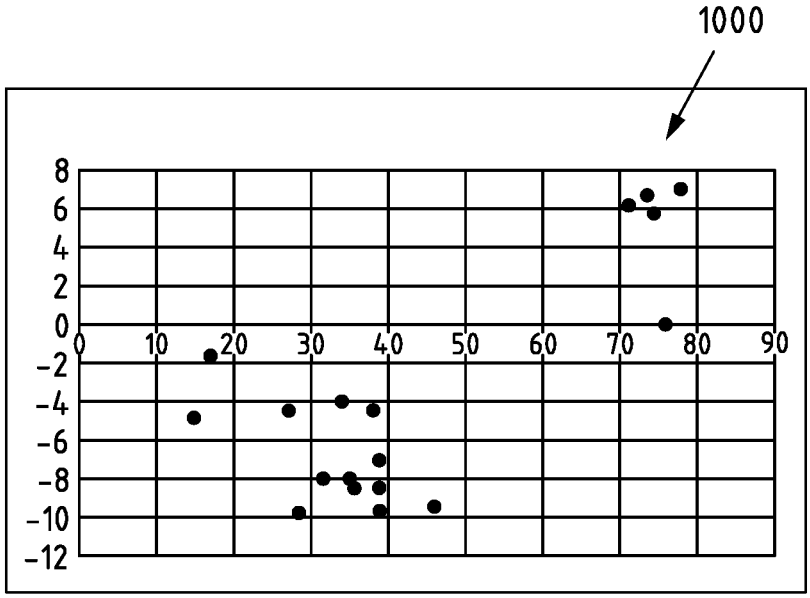
FIG. 10*a,b* illustrates probe data and clusters resulting from a cluster analysis.

FIG. 10*a* illustrates probe data 1000 comprising probe samples in the probe sample space (each probe sample comprising a d-value and a velocity value), which were collected in a travel network segment with only two different types of lanes (e.g. regular lane, HOV lane), such as travel network segment 501 or 503 of FIG. 5.

Figure 10B:
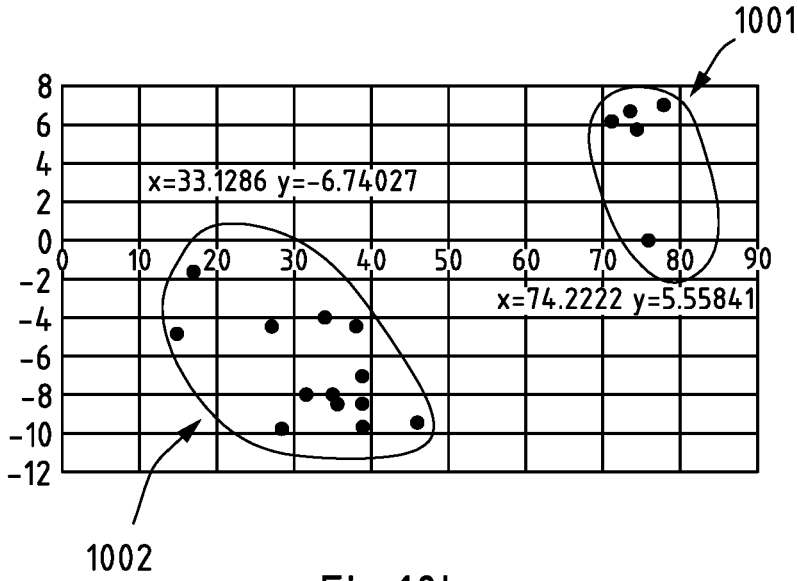

FIG. 10*b* shows the result of the cluster analysis (clusters 1001 and 1002) and that the method is robust enough to auto-detect also a bi-modal speed divergence, as the described cluster analysis will generate the number of clusters discovered as an output. The mean values of the clusters are given in the Figure. In this case the cluster analysis obtained two clusters as expected on a typical HOV segment without an exit ramp (such as travel network segment 501 or 503 of FIG. 5).

Figure 11A:
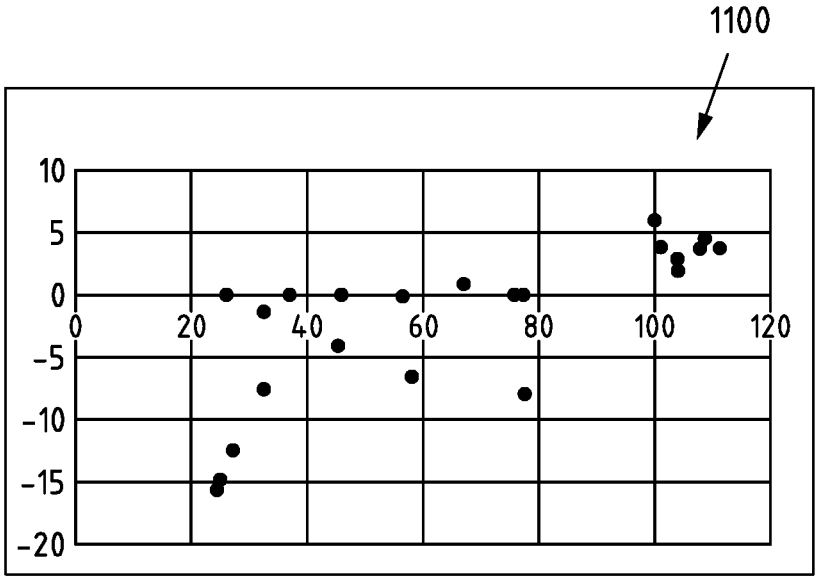
FIG. 11*a,b* illustrates probe data and clusters resulting from a cluster analysis.

Similarly to FIG. 8*a*, FIG. 11*a* illustrates probe data 1100 comprising probe samples in the probe sample space (each probe sample comprising a d-value and a velocity value), which were collected in a travel network segment with three different types of lanes (HOV lane, regular lane, exit lane), such as travel network segment 502 of FIG. 5.

Figure 11B:
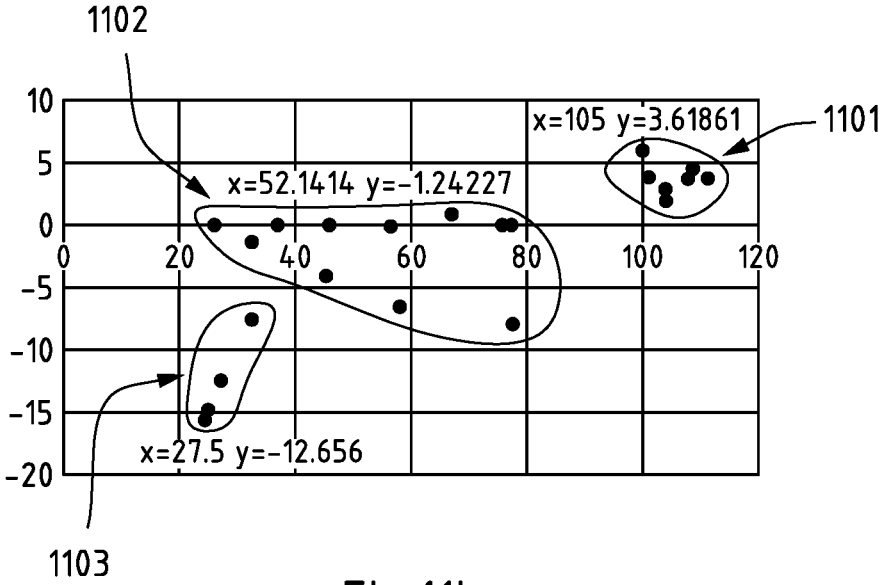

The cluster analysis returns three clusters 1101, 1102, 1103 illustrated in FIG. 11*b*, which can be interpreted as a mode each, i.e. as traffic participants on HOV lane(s) (cluster 1101), as traffic participants on regular lane(s) (cluster 1102), and as traffic participants on lane(s) towards the exit ramp (cluster 1103).

Returning to FIG. 2, according to action 214, confidence information is determined. The confidence metric may in one example be directly proportional to the size of the distance between the cluster means (or cluster centers) ("average cluster distance") and the probe-count of the smallest cluster ("minimum cluster count"). The confidence metric may also depend on the size of the bucket structure ("matrix diagonal length") and/or the total probe count of all clusters ("all cluster count"), e.g. confidence=calibration constant*(average cluster distance/matrix diagonal length)*(minimum cluster count/all clusters count).

According to action 215, it is checked if a multi-modal traffic scenario is given and if further conditions fulfilled (if applicable). This can e.g. be realized by checking whether a number of clusters determined by said cluster analysis is not less or above a predefined threshold (e.g. if at least three clusters are determined).

In that case (and if all further provided conditions are fulfilled) traffic information is provided or held available, which comprises information representative of or derived from said determined clusters, such as the average velocity of on a certain lane, action 216. Optionally confidence information may also be provided. The traffic information and the confidence information may be provided (i.e. published) by server to a navigation device, such as server 1 and navigation device 2 of FIG. 1.

The following Pseudo-Code with comments illustrates the cluster analysis:

```
V ← {a set of points in a Cartesian 2D space (x,y)}
function BCS(V(x,y), MG):
s ← STD(V(x*y))
// V(x*y) is Chebyshev-Dist(V(x/Δx,y/Δy), V(0,0));
m ← mean(V(x*y))
V ← V ∀ V < m + 2s & V > m − 2s
//outlier filtering
Range_x ← Range(V(x));
//range of x-axis only
Range_y ← Range(V(y));
Δx ← Range_x/20
Δy ← Range_y/20
// 20 by 20 grid of buckets
Lgap ← MG*Euclidean-Dist((max(Vx),max(Vy)),(0,0))
//0<MG<1 measure of gap
x0,y0,k ← 0;
Matrix[20][20] ← 0;
for i ← 1 to 20
```

-continued

```
//bucketizing 2D space into equal 20 by 20 matrix of buckets
for j ← 1 to 20
Matrix[i][j] ← new bucket(x0,y0)
//the point(x0,y0) is the base of the bucket closest to the origin
y0 ← y0+Δy
end for
x0 ← x0+Δx
end for
for each V
for each bucket ∈ Matrix[ ][ ]
If V within bucket
Then bucket.add(V)
//load data into the buckets
end for
for each bucket ∈ Matrix[ ][ ]
//find the center of each bucket
bucket.compute_mean_point( )
PriorityQueue ← bucket
//priority cost=Chebyshev-Dist(bucket_mean(x/Δx,y/Δy), V(0,0));
end for
C ← new Cluster
Clusters ← { }
for each non-empty bucket in PriorityQueue
//the main cluster search
IF Distance(C.mean_point − bucket.mean_point) < Lgap
//true if C is empty
Then C add V ∀ V ∈ bucket
Else IF all (C ∈ Clusters).mean_point − bucket.mean_point < Lgap
//check other clusters
Then C add V ∀ V ∈ bucket)
Else
Clusters add C
//keep discovered clusters
C ← new Cluster
C add V ∀ V ∈ bucket
//bucket must join one cluster
End IF
end for
return Clusters{ }
//final results is a List of clusters
END BCS
```

Figure 12:
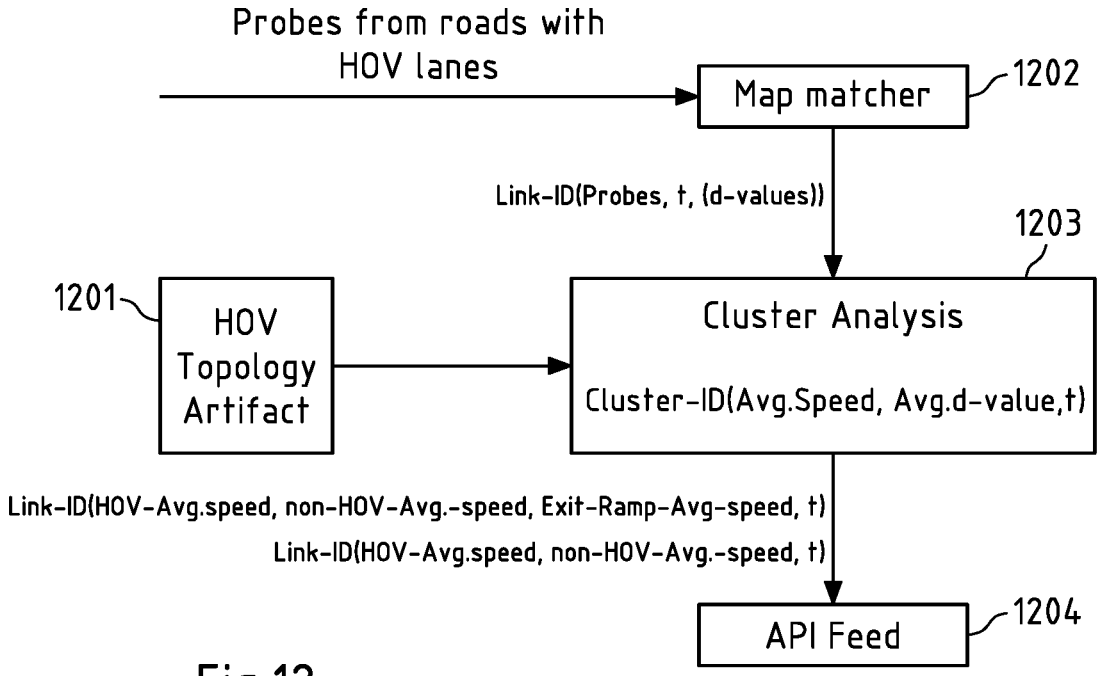
FIG. 12 shows an exemplary processing architecture which may be used for the described method.

FIG. 12 illustrates an exemplary processing architecture which may be used for the described method. The processing architecture can generally run in real-time but can also be adapted to work on batch data. The HOV topology artifact unit 1201 may store and provide travel network segments (strands or links), which relate to a potentially multi-modal traffic scenario (e.g. the HOV segments 501, 503 or the SLT segment 502 shown in FIG. 5). A map matcher 1202 may provide probe data for a respective segment for a respective time to a calculation unit 1203. The calculation unit 1203 may determine respective clusters with the average velocity and the average d-value for a respective time. The calculation unit 1203 may then further analyze the clusters in order to provide for the respective segment and the respective time the average speed for each of the modes (e.g. HOV-avg-speed, non-HOV-avg-speed, exit ramp-avg-speed). The calculation unit 1203 takes the decision if the traffic information should be published as a lane level traffic event or not. It looks at the number of modes, the degree of divergence of velocities, the delay difference in travel-time, at outlier probe clusters. Optionally, a confidence metric to accompany the lane-level traffic information is published. The results may be provided to an API feed 1204 for the traffic customers.

Figure 13:
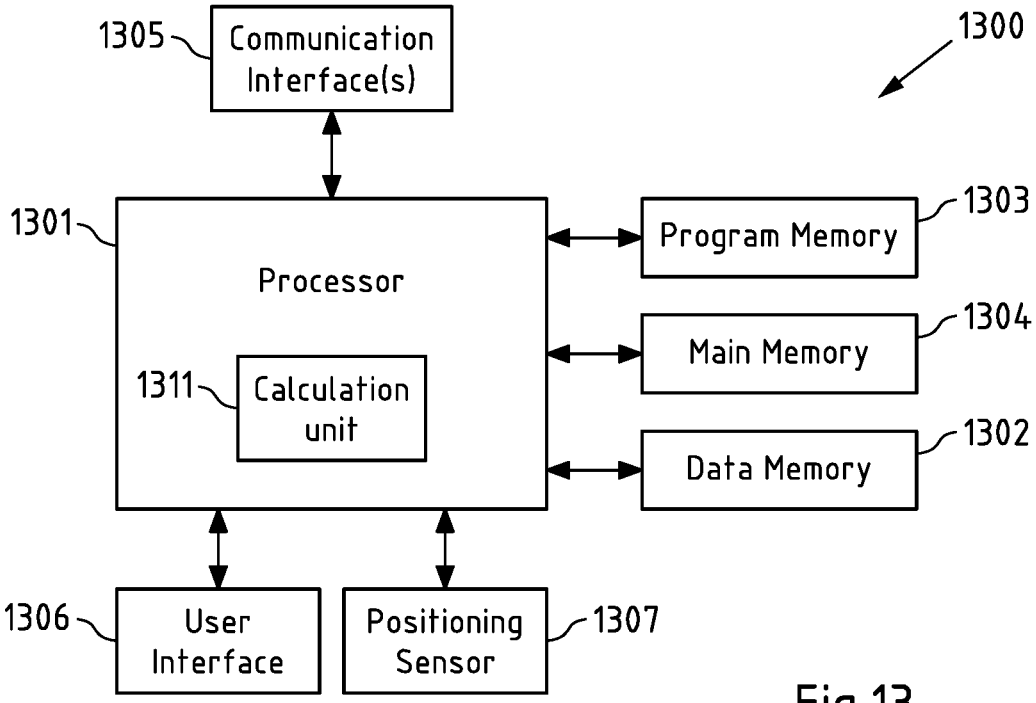
FIG. 13 shows a schematic block diagram of a (first) apparatus according to an example embodiment of the invention.

FIG. 13 is a schematic block diagram of an example embodiment of an apparatus 1300 according to the invention. Apparatus 1300 may for instance represent at least a part (e.g. a functional unit or module) of a server, e.g. server 1 or of a device, e.g. device 3 (see FIG. 1).

Apparatus 1300 comprises at least one processor 1301 and at least one program memory 1304 including computer program code, the at least one program memory 1304 and the computer program code configured to, with the at least one processor 1301, cause an apparatus (for instance apparatus 1300, or another apparatus that comprises apparatus 1300) at least to perform the method according to the first aspect of the present invention. Processor 1301 for instance executes the computer program code stored in program memory 1304. Processor 1301 for instance accesses program memory 1304 via a bus. The computer program code stored in program memory 1304 is an example of a computer program code according to the respective aspect of the present invention, i.e. a computer program code that when executed by processor 1301 causes apparatus 1300 (or an apparatus that comprises apparatus 1300) to perform the actions of the method according to the first aspect of the invention.

Apparatus 1300 is also an example embodiment of an apparatus that is configured to perform or comprises components for performing the method according to the first aspect of the present invention. The processor 1301 of apparatus 1300 comprises a calculation unit 1311 (e.g. calculation unit 1203), which may be configured to perform a cluster analysis for probe samples of probe data as described herein. Unit 1311 may be a separate component (e.g. sub-processors or cores) of processor 1301 or may be combined with other components in a single component of processor 1301.

Program memory 1304 may also be included into processor 1301. This memory may for instance be fixedly connected to processor 1301, or be at least partially removable from processor 1301, for instance in the form of a memory card or stick. Program memory 1304 may also comprise an operating system for processor 1301. Program memory 1304 may also comprise a firmware for apparatus 1300. Program memory 1304 may for instance comprise a first memory portion that is fixedly installed in apparatus 1300, and a second memory portion that is removable from apparatus 1300, for instance in the form of a removable SD memory card.

Apparatus 1300 further comprises data memory 1302. Processor 1301 for instance accesses data memory 1302 via a bus. Data memory 1302 may also be included into processor 1301. Data memory 1302 may for instance be fixedly connected to processor 1301, or be at least partially removable from processor 1301, for instance in the form of a memory card or stick. Data memory 1302 may for instance comprise a first memory portion that is fixedly installed in apparatus 1300, and a second memory portion that is removable from apparatus 1300, for instance in the form of a removable SD memory card.

Program memory 1304 and/or data memory 1302 may for instance be non-volatile memory. It may for instance be a FLASH memory (or a part thereof), any of a ROM, Programmable ROM (PROM), Erasable PROM (EPROM), Electrically Erasable PROM (EEPROM), Magnetoresistive Random Access Memory (MRAM) or a Ferroelectric Random Access Memory (FeRAM) memory (or a part thereof) or a hard disc (or a part thereof), to name but a few examples.

In the apparatus 1300, processor 1301 interfaces with a working memory 1303, for instance in the form of a volatile memory. It may for instance be a Random Access Memory (RAM) or Dynamic RAM (DRAM), to give but a few non-limiting examples. It may for instance be used by processor 1301 when executing an operating system and/or computer program code.

Processor 1301 further controls a communication interface 1305 configured to receive and/or output data and/or information. For instance, communication interface 1305 may be configured to communicate with one or more remote devices, e.g. with device 2 (see FIG. 1). This may for instance comprise receiving information (e.g. probe data) from remote devices and/or transmitting information such as data (e.g. traffic information) to the remote devices. The communication may for instance at least partially (or entirely) be based on a wireless communication connection. The communication interface 1305 may thus comprise circuitry such as modulators, filters, mixers, switches and/or one or more antennas to allow transmission and/or reception of signals, e.g. for the communication with the remote devices. In embodiments of the invention, communication interface 1305 is inter alia configured to allow communication according to a 2G/3G/4G/5G cellular communication system and/or a non-cellular communication system, such as for instance a WLAN network. Nevertheless, the communication connection between apparatus 1300 and the remote devices may equally well at least partially comprise wire-bound portions. For instance, apparatus 1300 may be connected to a back-bone of a wireless communication system (associated with the remote devices) via a wire-bound system such as for instance the Internet.

Processor 1301 (and also any other processor mentioned in this specification) may be a processor of any suitable type. Processor 1301 may comprise but is not limited to one or more microprocessor(s), one or more processor(s) with accompanying one or more digital signal processor(s), one or more processor(s) without accompanying digital signal processor(s), one or more special-purpose computer chips, one or more field-programmable gate array(s) (FPGA(s)), one or more controller(s), one or more application-specific integrated circuit(s) (ASIC(s)), or one or more computer(s). The relevant structure/hardware has been programmed in such a way to carry out the described function. Processor 1301 may for instance be an application processor that runs an operating system.

In particular in case the apparatus 1300 represents device 3, processor 1301 may control a user interface 1306, which may for instance be configured for interaction with a user of apparatus 1300. User interface 1306 may for instance comprise a display, a keyboard and/or a touch-sensitive surface. Processor 1301 may also interface with a positioning sensor 1307, which may for instance determine the position of apparatus 1300, e.g. to collect probe data. Positioning sensor 1307 may for instance comprise a Global Positioning System (GPS) receiver and/or a Global Navigation Satellite System (GLONASS) receiver.

Some or all of the components of the apparatus 1300 may for instance be connected via a bus. Some or all of the components of the apparatus 1300 may for instance be combined into one or more modules.

Figure 14:
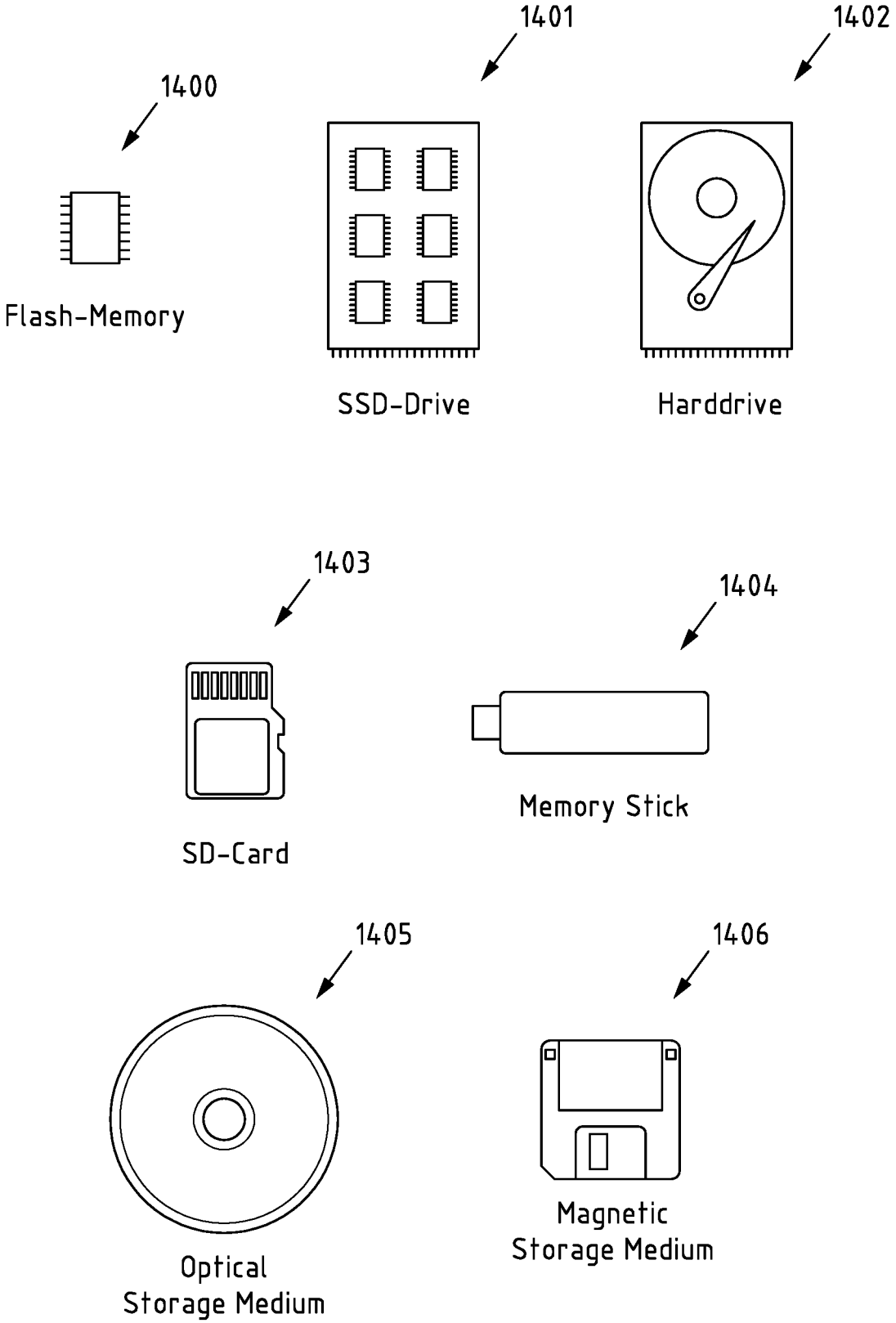
FIG. 14 shows a schematic illustration of examples of tangible and non-transitory storage media according to the present invention.

FIG. 14 is a schematic illustration of examples of tangible computer-readable storage media according to the present invention that may for instance be used to implement program memory 1304, and/or data memory 1302 of FIG. 13. To this end, FIG. 14 displays a flash memory 1400, which may for instance be soldered or bonded to a printed circuit board, a solid-state drive 1401 comprising a plurality of memory chips (e.g. Flash memory chips), a magnetic hard drive 1402, a Secure Digital (SD) card 1403, a Universal Serial Bus (USB) memory stick 1404, an optical storage medium 1405 (such as for instance a CD-ROM or DVD) and a magnetic storage medium 1406.

In the present specification, any presented connection in the described embodiments is to be understood in a way that the involved components are operationally coupled. Thus, the connections can be direct or indirect with any number or combination of intervening elements, and there may be merely a functional relationship between the components.

Moreover, any of the methods, processes and actions described or illustrated herein may be implemented using executable instructions in a general-purpose or special-purpose processor and stored on a computer-readable storage medium (e.g., disk, memory, or the like) to be executed by such a processor. References to a 'computer-readable storage medium' should be understood to encompass specialized circuits such as FPGAs, ASICs, signal processing devices, and other devices.

The expression "A and/or B" is considered to comprise any one of the following three scenarios: (i) A, (ii) B, (iii) A and B. Furthermore, the article "a" is not to be understood as "one", i.e. use of the expression "an element" does not preclude that also further elements are present. The term "comprising" is to be understood in an open sense, i.e. in a way that an object that "comprises an element A" may also comprise further elements in addition to element A.

It will be understood that all presented embodiments are only exemplary, and that any feature presented for a particular example embodiment may be used with any aspect of the invention on its own or in combination with any feature presented for the same or another particular example embodiment and/or in combination with any other feature not mentioned. In particular, the example embodiments presented in this specification shall also be understood to be disclosed in all possible combinations with each other, as far as it is technically reasonable and the example embodiments are not alternatives with respect to each other. It will further be understood that any feature presented for an example embodiment in a particular category (method/apparatus/computer program code) may also be used in a corresponding manner in an example embodiment of any other category. It should also be understood that presence of a feature in the presented example embodiments shall not necessarily mean that this feature forms an essential feature of the invention and cannot be omitted or substituted.

The sequence of all method steps presented above is not mandatory, also alternative sequences may be possible. Nevertheless, the specific sequence of method steps exemplarily shown in the figures shall be considered as one possible sequence of method steps for the respective embodiment described by the respective figure.

The invention has been described above by means of example embodiments. It should be noted that there are alternative ways and variations which are obvious to a skilled person in the art and can be implemented without deviating from the scope of the appended claims.

The following embodiments of the invention shall also be considered to be disclosed:

1. A method, performed by at least one apparatus, the method comprising:
   obtaining probe data comprising a plurality of probe samples of a multi-dimensional probe sample space, the probe data being representative of a potentially multi-modal traffic scenario;
   performing a cluster analysis for at least a part of the probe samples of the probe data, said cluster analysis comprising:
   associating at least a part of the probe samples with respective clusters, each cluster being representative of a mode of the potentially multi-modal traffic scenario.
2. The method according to embodiment 1, wherein one dimension of the multi-dimensional probe sample space indicates velocities of respective traffic participants and/or one dimension of the multi-dimensional probe sample space indicates geographical positions of respective traffic participants.
3. The method according to embodiment 1 or 2, wherein each of at least a part of the probe samples comprises information representative of a respective velocity of a traffic participant and/or information representative of a geographical position of a respective traffic participant.
4. The method according to any of the preceding embodiments, wherein the traffic scenario relates to the traffic at a travel network segment.
5. The method according to embodiment 4, wherein the travel network segment comprises or is adjacent to a travel network segment that comprises multiple, in particular at least three different lanes and/or splits into multiple, in particular at least two, preferably at least three different directions.
6. The method according to embodiment 4 or 5, wherein the travel network segment comprises at least one restricted traffic lane, in particular a high-occupancy vehicle lane.
7. The method according to any of the preceding embodiments, wherein a mode of the potentially multi-modal traffic scenario represents a group of traffic participants using the same lane, using the same means of transportation, moving in a certain direction, and/or having a certain velocity.
8. The method according to any of the preceding embodiments, said method further comprising:
   obtaining a gap value indicative of a threshold gap distance between a potential cluster element and a cluster for deciding whether the potential cluster element is to be added to said cluster and preferably using said gap value as an input for said cluster analysis.
9. The method according to any of the preceding embodiments, said cluster analysis further comprising:
   determining a threshold gap distance, wherein said threshold gap distance is preferably based on said obtained gap value.
10. The method according to any of the preceding embodiments, said cluster analysis further comprising:
    detecting whether one or more probe samples of probe data are outliers; and
    disregarding a probe sample if it is determined that the respective probe sample is an outlier.
11. The method according to any of the preceding embodiments, said cluster analysis further comprising:
    defining a plurality of buckets, each bucket being associated with a section of the multi-dimensional probe sample space; and
    for each of said buckets filling the respective bucket with probe samples lying within a respective section of the multi-dimensional probe sample space, with which the respective bucket is associated.
12. The method according to embodiment 11, said cluster analysis further comprising:
    creating a priority order, said priority order indicating a processing order of the buckets during the cluster analysis, wherein said priority order is in particular based on a distance, preferably a Chebyshev distance of a respective bucket to a reference point.

13. The method according to embodiment 11 or 12, said cluster analysis further comprising:
checking whether a distance between a respective bucket and a cluster is less or not greater than a threshold gap distance; and
associating the probe samples, which are contained in the respective bucket, with the cluster, if it is determined by the checking that the distance between the respective bucket and the cluster is less or not greater than a threshold gap distance.
14. The method according to embodiment 13, said cluster analysis further comprising:
creating a new cluster and associating the probe samples, which are contained in the respective bucket, with the new cluster, if it is determined by the checking that the distance between the respective bucket and all clusters is greater or not less than a threshold gap distance.
15. The method according to any of the preceding embodiments, said method further comprising:
detecting whether one or more clusters determined by said cluster analysis are outliers; and
disregarding a cluster if it is determined that the respective cluster is an outlier.
16. The method according to any of the preceding embodiments, said method further comprising:
determining a mean of each determined cluster for obtaining traffic information from said determined clusters.
17. The method according to any of the preceding embodiments, said method further comprising:
providing or holding available traffic information comprising information representative of or derived from said determined clusters.
18. The method according to embodiment 17, wherein said traffic information is provided or held available, if it is determined that a multi-modal traffic scenario is given.
19. The method according to embodiment 17 or 18, wherein said traffic information is provided to or held available for a navigation device.
20. The method according to any of the preceding embodiments, said method further comprising:
checking whether a number of clusters determined by said cluster analysis is not less or above a predefined threshold in order to determine whether a multi-modal traffic scenario is given.
21. The method according to any of the preceding embodiments, said method further comprising:
determining confidence information for the result of the cluster analysis based on a cluster distance and/or a number of probe samples associated with the smallest cluster.
22. The method according to embodiment 21, said method further comprising:
providing or holding available the confidence information together with the traffic information.
23. An apparatus configured to perform and/or control or comprising respective means for performing and/or controlling the method of one of the preceding embodiments.
24. An apparatus, comprising at least one processor and at least one memory including computer program code, the at least one memory and the computer program code configured to, with the at least one processor, cause an apparatus at least to perform and/or control the method according to one of the preceding embodiments.
25. A computer program code, the computer program code when executed by a processor causing an apparatus to perform and/or control the actions of the method of one of the preceding embodiments.
26. A system comprising:
a first apparatus according to one of embodiments 23-24;
a navigation device configured to receive traffic information provided or held available by the first apparatus.

That which is claimed is:

1. A method, performed by at least one apparatus, the method comprising:
obtaining probe data comprising a plurality of probe samples of a multi-dimensional probe sample space, the probe data being indicative of a multi-modal traffic scenario;
obtaining a gap value indicative of a threshold gap distance between a potential cluster element and a cluster for deciding whether the potential cluster element is to be added to said cluster, wherein the gap value indicates a fraction of a total size of the probe sample space covered by the probe samples; and
performing a cluster analysis for at least a part of the probe samples of the probe data using said gap value, said cluster analysis comprising:
grouping at least a part of the probe samples with respective clusters utilizing, at least in part, the gap value, each cluster being indicative of a mode of the multi-modal traffic scenario.

2. The method according to claim 1, wherein one dimension of the multi-dimensional probe sample space indicates velocities of respective traffic participants and one dimension of the multi-dimensional probe sample space indicates geographical positions of respective traffic participants.

3. The method according to claim 1, wherein each of at least a part of the probe samples comprises information indicative of a respective velocity of a traffic participant and information indicative of a geographical position of a respective traffic participant.

4. The method according to claim 1, wherein a mode of the multi-modal traffic scenario represents a group of traffic participants using a same lane, using a same means of transportation, moving in a certain direction, or having a certain velocity.

5. The method according to claim 1, said cluster analysis further comprising:
determining a threshold gap distance, wherein said threshold gap distance is based on said obtained gap value.

6. The method according to claim 1, said cluster analysis further comprising:
detecting whether one or more probe samples of probe data are outliers; and
disregarding a probe sample in response to the respective probe sample being an outlier.

7. The method according to claim 1, said method further comprising:
detecting whether one or more clusters determined by said cluster analysis are outliers; and
disregarding a cluster in response to the respective cluster being an outlier.

8. The method according to claim 1, said method further comprising:
determining a mean of each determined cluster for obtaining traffic information from said determined clusters.

9. The method according to claim 1, said method further comprising:
checking whether a number of clusters determined by said cluster analysis is not less or above a predefined threshold in order to determine whether a multi-modal traffic scenario is given.

10. The method according to claim 1, wherein a number of clusters is determined by the cluster analysis.

11. The method according to claim 1, wherein the traffic scenario is a traffic situation at a travel network segment.

12. The method according to claim 11, wherein the travel network segment comprises or is adjacent to a travel network segment that comprises at least three different lanes and splits into at least two different directions.

13. The method according to claim 11, wherein the travel network segment comprises at least one restricted traffic lane.

14. The method according to claim 1, said cluster analysis further comprising:

defining a plurality of buckets, each bucket being grouped with a section of the multi-dimensional probe sample space; and for each of said buckets filling the respective bucket with probe samples lying within a respective section of the multi-dimensional probe sample space, with which the respective bucket is grouped.

15. The method according to claim 14, said cluster analysis further comprising:

creating a priority order, said priority order indicating a processing order of the buckets during the cluster analysis, wherein said priority order utilizes a Chebyshev distance of a respective bucket to a reference point.

16. The method according to claim 14, said cluster analysis further comprising:

determining whether a distance between a respective bucket and a cluster is less or not greater than the threshold gap distance; and grouping the probe samples, which are contained in the respective bucket, with the cluster in response to the distance between the respective bucket and the cluster failing to satisfy a threshold gap distance.

17. The method according to claim 16, said cluster analysis further comprising:

creating a new cluster and grouping the probe samples, which are contained in the respective bucket, with the new cluster in response to the distance between the respective bucket and all clusters satisfying the threshold gap distance.

18. The method according to claim 1, said method further comprising:

providing or holding available traffic information comprising information indicative of or derived from said determined clusters.

19. The method according to claim 18, wherein said traffic information is provided to or held available for a navigation device.

20. The method according to claim 1, said method further comprising:

determining confidence information for the result of the cluster analysis utilizing a cluster distance or a number of probe samples grouped with the smallest cluster.

21. The method according to claim 20, said method further comprising:

providing or holding available the confidence information together with the traffic information.

22. An apparatus configured to perform and/or control or comprising respective means for performing or controlling the method of claim 1.

23. A system comprising:

a first apparatus according to claim 22; and a navigation device configured to receive traffic information provided or held available by the first apparatus.

24. An apparatus, comprising at least one processor and at least one memory including computer program code, the at least one memory and the computer program code configured to, with the at least one processor, cause an apparatus to:

obtain probe data comprising a plurality of probe samples of a multi-dimensional probe sample space, the probe data being indicative of a multi-modal traffic scenario;

obtain a gap value indicative of a threshold gap distance between a potential cluster element and a cluster for deciding whether the potential cluster element is to be added to said cluster, wherein the gap value indicates a fraction of a total size of the probe sample space covered by the probe samples; and perform a cluster analysis for at least a part of the probe samples of the probe data using said gap value, said cluster analysis comprising:

group at least a part of the probe samples with respective clusters utilizing, at least in part, the gap value, each cluster being indicative of a mode of the multi-modal traffic scenario.

25. A computer program product comprising at least one non-transitory computer-readable storage medium having computer program code portions stored therein, the computer program code portions, when executed by a processor cause an apparatus to:

obtain probe data comprising a plurality of probe samples of a multi-dimensional probe sample space, the probe data being indicative of a multi-modal traffic scenario;

obtain a gap value indicative of a threshold gap distance between a potential cluster element and a cluster for deciding whether the potential cluster element is to be added to said cluster, wherein the gap value indicates a fraction of a total size of the probe sample space covered by the probe samples; and perform a cluster analysis for at least a part of the probe samples of the probe data using said gap value, said cluster analysis comprising:

group at least a part of the probe samples with respective clusters utilizing, at least in part, the gap value, each cluster being indicative of a mode of the multi-modal traffic scenario.

* * * * *